United States Patent [19]

Fraser et al.

[11] 4,078,781

[45] Mar. 14, 1978

[54] CLAMPS

[75] Inventors: Ian Bruce Fraser, Codicote; David Anthony Whitbread, Flamstead, both of England

[73] Assignee: HMC-Brauer Limited, Bucks, England

[21] Appl. No.: 748,320

[22] Filed: Dec. 7, 1976

[51] Int. Cl.[2] ..... B25B 1/02

[52] U.S. Cl. ..... 269/171

[58] Field of Search ..... 269/166–171.5, 269/212, 215, 249, 271, 238, 240, 309

[56] References Cited

U.S. PATENT DOCUMENTS

| | | | |
|---|---|---|---|
| 305,963 | 9/1884 | Richards | 269/271 |
| 573,745 | 12/1896 | Wilson | 269/240 |
| 1,811,518 | 6/1931 | Palmer | 269/166 |
| 3,331,111 | 7/1967 | Carver | 269/171 |
| 3,373,988 | 3/1968 | McKelvey | 269/309 |
| 3,758,100 | 9/1973 | Taylor et al. | 269/238 |

FOREIGN PATENT DOCUMENTS

| | | | |
|---|---|---|---|
| 863,441 | 3/1961 | United Kingdom | 269/171 |

*Primary Examiner*—Robert C. Watson

*Attorney, Agent, or Firm*—Scrivener, Parker, Scrivener and Clarke

[57] ABSTRACT

An adjustable clamp has its main bar formed from flat metal strip with serrations in one edge and a fixed arm may be formed by a bent-around end of this strip. The moving arm can be formed from two flat stampings from strip and a fine adjustment is provided by a screw on this arm, engaging the non-serrated edge of the bar, while the coarse adjustment is provided by a bush or pin between the stampings engaging the serrated edge.

4 Claims, 10 Drawing Figures

CLAMPS

SPECIFIC DESCRIPTION

This invention relates to clamps such as are used in engineering and woodwork and are often known as C-clamps, comprising a bar carrying either a fixed jaw at one end and an adjustable jaw which is capable of being moved to any position along the bar, or carrying two jaws, both mounted movably on it.

In one known form of C-clamp the or each movable jaw is carried on an arm that extends laterally from the bar and the arm has an aperture or slot by which the arm embraces the bar, the slot having a pair of offset abutments which engage opposite edges of the bar to cause the arm to become jammed on the bar when a load is applied by the workpiece to the associated jaw in a direction parallel to the length of the bar. This provides a coarse adjustment. The fine adjustment, serving to apply the clamping load to the workpiece, is provided either by mounting the jaw on the arm through the medium of a screw that extends parallel to the length of the bar or by making one of the jamming abutments movable with respect to the arm, by mounting it on a screw or by making it in the form of a cam.

One edge of the bar may be serrated to provide notches ensuring positive location of the one abutment for the coarse setting, rather than relying solely on friction.

The aim of the present invention is to provide further detailed improvements in a clamp of the above general class. According to one feature of the invention the bar is simply formed from rolled metal strip, preferably steel strip, and the mounting for the fixed jaw (where present) is formed by bending round a portion of one end of the strip in the plane of the strip.

Likewise the adjustable arm is preferably formed from steel strip or sheet, in this case two stampings riveted together with a gap between them to define the aperture through which the bar passes. One of the rivets may be of a form such that a centre portion of it lying between the stampings forms one of the abutments. Where the fine adjustment is provided by mounting the jaw on the arm through the medium of a screw, the second abutment may be formed in the same way as the first. However, in a preferred version the jaw is riveted directly to the free end of the arm (though in a manner allowing it to tilt) and the second abutment is formed by the tip of a screw.

Further features of the invention will be revealed by a study of the following detailed description of a preferred embodiment, and some modifications, with reference to the accompanying drawings, in which.

Figure 1:
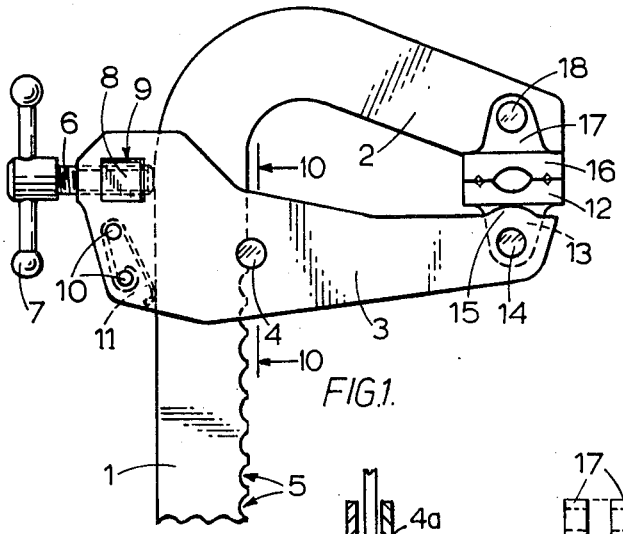
FIG. 1 is a view of the clamp in its fully closed position.
Figure 10:
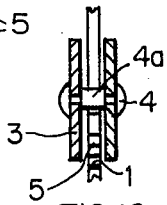
FIG. 10 is a fragmentary vertical cross-sectioned view taken substantially on the line 10—10 of FIG. 1.

Referring first to FIG. 1, the clamp comprises basically a bar 1 of mild steel strip, of which one end is bent around in the plane of the major axis of the bar to form a fixed arm 2. The other end of the bar (not shown) is of any suitable length, according to the work-holding capacity required. Slidably mounted on the bar 1 is a movable arm formed by two flat stampings 3 from metal strip. A rivet 4 secures the stampings together near their central regions and, as shown in FIG. 10, the rivet has between the stampings, an enlarged central portion 4*a* which has the dual function of spacing the stampings apart and of forming a first abutment for engaging one edge of the bar, this edge being provided with a row of serrations 5, in any one of which the rivet can rest.

A second abutment, engaging the opposite edge of the bar 1 (this edge having no serrations) is formed by the tip of a screw 6 which carries a tommy bar 7 and is in screw-threaded engagement with a rectangular block 8 through which it passes. This block is received in square openings 9 formed in the stampings 3. The presence of the screw 6 holds the block loosely in place between the stampings.

Two further rivets 10 form locating means for a leaf spring 11 which bears against the smooth edge of the bar 1 and urges the bar clockwise about the rivet 4 (as viewed in FIG. 1) to keep the tip of the screw 6 lightly in contact with the bar. It will be noted that the two abutments formed by the rivet 4 and the tip of the screw 6 are offset in relation to the length of the bar 1, so that a clockwise couple exerted on the movable arm will cause it to jam on the bar 1.

The free end of the movable arm carries a jaw 12 having a lug 13 which enters between the ends of the stampings 3 and is secured by a rivet 14 in a manner that leaves the jaw free to rock through a limited arc to align itself with the surface of a workpiece. Arcuate cheeks 15 on the stampings 3 ensure that the load on the jaw 12 is transmitted directly to the arm and not in shear through the rivet 14.

The fixed arm 2 carries a similar jaw 16 but with spaced lugs 17 to embrace the tip of the arm; the jaw is held by a rivet 18.

Figure 2:
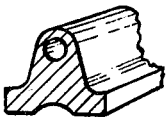
FIG. 2 is an isometric view of the extrusion from which the jaws of the clamp of FIG. 1 are made.
Figure 3:
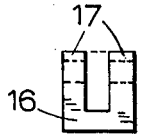
FIGS. 3 and 4 show respectively the two jaws made from the extrusion of FIG. 2, looking in a direction which lies in the plane of the drawing of FIG. 1.
Figure 4:
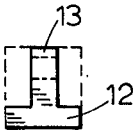

Both jaws 12 and 16 are produced by cutting off portions of an extrusion, for example of light alloy, of the section shown in FIG. 2. For the jaw 16 a slot is milled in the cut-off portion, as shown in FIG. 3, to define the two spaced lugs 17, whilst for the jaw 12 two side portions are cut away, as shown in FIG. 4, to leave the single lug 13. This forms a particularly neat and economical way of forming the two kinds of jaw without resorting to casting, forging or extensive machining.

Figure 5:
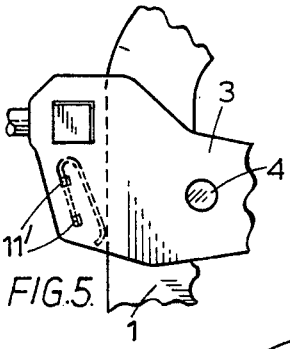
FIG. 5 is a view of part of a clamp with a modified form of spring.
Figure 6:
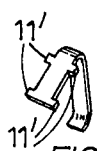
FIG. 6 is an isometric view of the spring used in the clamp of FIG. 5.

FIGS. 5 and 6 show a modified mounting arrangement for the spring, which, in place of the leaf spring 11 of FIG. 1, has ears shown at 11′ engaging in spaced holes in the two stampings 3, so that the need for the rivets 10 is eliminated.

Figure 7:
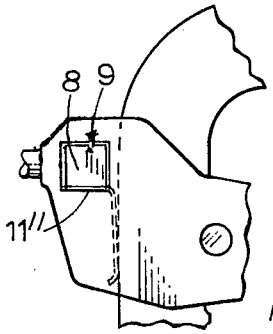
FIG. 7 is a view of part of a clamp with a third form of spring.
Figure 8:
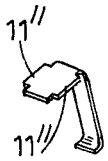
FIG. 8 is an isometric view of the spring used in the clamp of FIG. 7.

FIGS. 7 and 8 show a third way of mounting the spring, which is shown in FIG. 8 as having two ears 11″. These are received in the square openings 9 already provided for the block 8, and the presence of the block holds the spring in place.

Instead of having one fixed arm and one moving arm, the clamp could have a straight bar 1 with the end portion 2 omitted, and this bar could carry two movable arms, both identical with the one described. They could moreover be put on the bar back to back instead of facing each other, allowing the clamp to be used to urge the surfaces apart instead of together.

Figure 9:
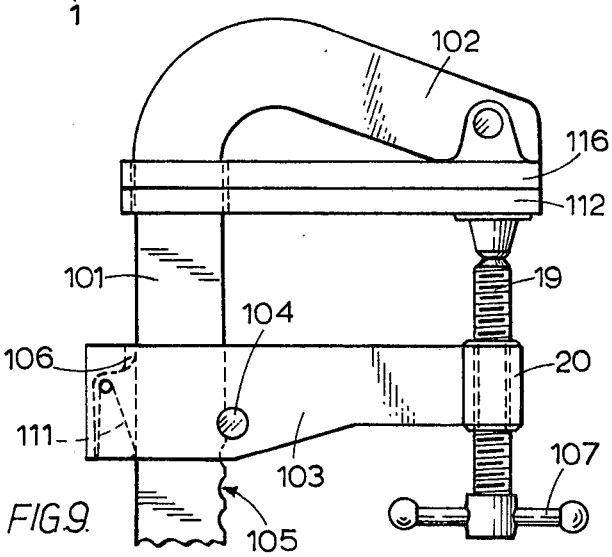
FIG. 9 is a view similar to FIG. 1, showing a modified form of clamp.

FIG. 9 shows a further modified form of clamp. Here the reference numerals are the same as in FIG. 1 where applicable, but with an extra hundred added on. The movable arm 103 has opposed offset abutments 104 and 106, but the latter is fixed to the arm, being clamped between its two stampings. A leaf spring 111 bent to a hairpin shape acts to tilt the arm in a direction causing the abutments to engage the bar. The fine adjustment, instead of being achieved by making one of the abutments movable to alter the tilt of the whole arm, is provided by mounting the movable jaw 112 on a screw 19 which is in screw-threaded engagement with a bush 20 on the free end of the arm 103, so as to be movable with respect to the arm in a direction parallel to the length of the bar 101 by the use of a tommy bar 107. The greater the load on the workpiece the more is the arm loaded in a direction urging the abutments 104 and 106 into engagement with opposite edges of the bar 101.

The jaws 112 and 116 in the embodiment of FIG. 9 are both of extended shape and have openings through which the bar 101 passes; this helps to guide the jaws and in particular prevents the moving jaw tending to turn with the screw 19.

We claim:

1. A workpiece clamp comprising a bar of essentially flat rectangular cross-section defining first and second minor edges, said first edge being serrated and said second edge being smooth, a movable arm embracing and slidable on said bar, said arm extending in a general direction perpendicular to the length of said bar and parallel to the planes of the major faces thereof, and comprising first and second flat metal stampings lying on opposite sides of said bar and rivet means passing through said stampings to secure said stampings together, a further arm extending perpendicular to the length of said bar and parallel to the planes of the major faces thereof, first and second jaws mounted respectively on the free ends of said movable arm and said further arm, said rivet means engaging said first edge of the bar and adapted to engage the serrations thereof to form a first abutment, a second abutment on said movable arm, said second abutment engaging said second edge of the bar in a region displaced along the length of said bar from the point on said first edge engaged by said first abutment, and manually adjustable screw means mounted on said movable arm for movement in a direction parallel to the length of said movable arm and acting to move said second abutment in said direction, whereby to tilt said arm with respect to said bar about said rivet means and thereby move said first jaw with respect to said second jaw in a direction generally parallel to said bar, a block located in openings in said stampings, said block having a screw-threaded hole therein and receiving said screw means, a leaf spring mounted on said movable arm and bearing against said second edge of the bar to tilt said arm in a direction to cause said rivet means and said second abutment to engage said bar, said leaf spring including laterally projecting ears, said ears forming means locating said spring in said block-locating openings.

2. A workpiece clamp comprising a bar of essentially flat rectangular cross-section degining first and second minor edges, said first edge being serrated and said second edge being smooth, a movable arm embracing and slidable on said bar, said arm extending in a general direction perpendicular to the length of said bar and parallel to the planes of the major faces thereof, and comprising first and second flat metal stampings lying on opposite sides of said bar and rivet means passing through said stampings to secure said stampings together, said rivet means having an enlarged central portion between the stampings spacing the same apart, a further arm extending perpendicular to the length of said bar and parallel to the planes of the major faces thereof, first and second jaws mounted respectively on the free ends of said movable arm and said further arm, the central part of said rivet means engaging said first edge of the bar and being received in a selected one of the serrations thereof to form a first abutment, a second abutment on said movable arm, said second abutment engaging said second edge of the bar in a region displaced along the length of said bar from the point on said first edge engaged by said first abutment, and manually adjustable screw means mounted on said movable arm for movement in a direction parallel to the length of said bar and supporting said first jaw whereby to move said first jaw with respect to said movable arm in a direction parallel to said bar.

3. A workpiece clamp comprising a bar of essentially flat rectangular cross-section defining first and second minor edges, said first edge being serrated and said second edge being smooth, a movable arm embracing and slidable on said bar, said arm extending in a general direction perpendicular to the length of said bar and parallel to the planes of the major faces thereof, and comprising first and second flat metal stampings lying on opposite sides of said bar and rivet means passing through said stampings to secure said stampings together, said rivet means having an enlarged central portion between the stampings spacing the same apart, a further arm extending perpendicular to the length of said bar and parallel to the planes of the major faces thereof, first and second jaws mounted respectively on the free ends of said movable arm and said further arm, the central part of said rivet means engaging said first edge of the bar and being received in a selected one of the serrations thereof to form a first abutment, a second abutment on said movable arm, said second abutment engaging said second edge of the bar in a region displaced along the length of said bar from the point on said first edge engaged by said first abutment, and manually adjustable screw means mounted on said movable arm for movement in a direction parallel to the length of said movable arm and acting to move said second abutment in said direction, whereby to tilt said arm with respect to said bar about said rivet means and thereby move said first jaw with respect to said second jaw in a direction generally parallel to said bar.

4. The clamp set forth in claim 3 wherein said first and second jaws are both of common cross-section, being formed by cut-off portions of a common extruded metal section, said first jaw having a single lug thereon, said lug being received between and secured to said stamping means, and said second jaw having a slot formed therein to define a pair of spaced lugs, said spaced lugs embracing and being secured to said further arm.

* * * * *